United States Patent [19]

Falero

[11] Patent Number: 4,864,976

[45] Date of Patent: Sep. 12, 1989

[54] INTERNAL COMBUSTION ENGINE AND PISTON STRUCTURE THEREFORE

[76] Inventor: Avelino Falero, Post Office Box 618, Juncos, P.R. 00666

[21] Appl. No.: 199,767

[22] Filed: May 27, 1988

[51] Int. Cl.[4] ..... F02B 75/04; F02B 75/36

[52] U.S. Cl. ..... 123/48 B; 123/78 BA; 123/197 R

[58] Field of Search ..... 123/58 R, 56 AC, 56 BC, 123/59 R, 59 A, 59 B, 197 R, 197 AC, 48 B, 78 BA, 78 E

[56] References Cited

U.S. PATENT DOCUMENTS

| | | | |
|---|---|---|---|
| 1,123,172 | 12/1974 | Compton | 123/197 AC |
| 1,399,666 | 12/1921 | Short | 123/56 AC |
| 1,636,612 | 7/1927 | Noah | 123/197 R |
| 1,687,744 | 10/1928 | Webb . | |
| 2,122,676 | 7/1938 | Bourke . | |
| 2,122,677 | 7/1938 | Bourke . | |
| 2,172,670 | 9/1939 | Bourke . | |
| 3,886,805 | 6/1975 | Koderman | 123/197 AC |
| 4,395,977 | 8/1983 | Pahis | 123/55 AA |
| 4,485,768 | 12/1984 | Heniges | 123/48 B |
| 4,608,951 | 9/1986 | White | 123/197 AC |
| 4,658,768 | 4/1987 | Carson | 123/197 AC |

FOREIGN PATENT DOCUMENTS

| | | | |
|---|---|---|---|
| 107101 | 4/1939 | Australia . | |
| 514842 | 11/1939 | United Kingdom . | |
| 3607422 | 9/1987 | Fed. Rep. of Germany | 123/197 R |
| 838777 | 3/1939 | France . | |
| 369362 | 3/1939 | Italy . | |
| 0909250 | 3/1982 | U.S.S.R. | 123/56 R |

OTHER PUBLICATIONS

SAE Technical Paper Series, "Experimental Development of Two New Types of Double Piston Engines", Soichi Ishihara, International Congress and Exposition; Feb.-1986.

Bourke Engine Documentary, Lois Burke, pp. 28–45, 54–56, 103–105, 111–115, 142–147; 1968.

*Primary Examiner*—David A. Okonsky

*Attorney, Agent, or Firm*—Oliff & Berridge

[57] ABSTRACT

A reciprocating internal combustion engine includes a dual-headed piston body formed by two piston heads mounted at opposite ends of a central yoke structure. The piston heads are adapted to reciprocate within respective opposed cylinders of a coaxially aligned cylinder pair. An internally toothed roller gear is mounted for rectilinear movement within the yoke structure. The roller gear is engageable with a crankshaft drive gear and control and actuator means are provided for effecting sychronized movement of the roller gear within the yoke structure to maintain constant engagement of the roller gear with the crankshaft drive gear as the pistons of the dual-headed piston body reciprocate within respective cylinders of the cylinder pair. The central yoke structure of the dual-headed piston body is adapted to receive roller gears of different size, thus allowing the piston stroke and cylindrical volume of the engine to be varied.

18 Claims, 4 Drawing Sheets

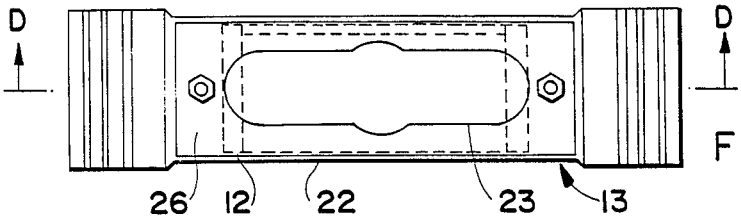
Fig. 4A
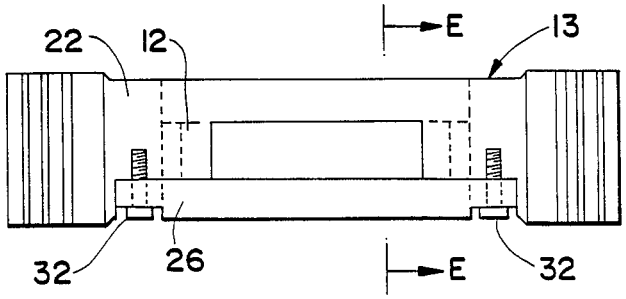
Fig. 4B
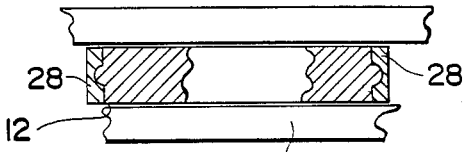
Fig. 4C
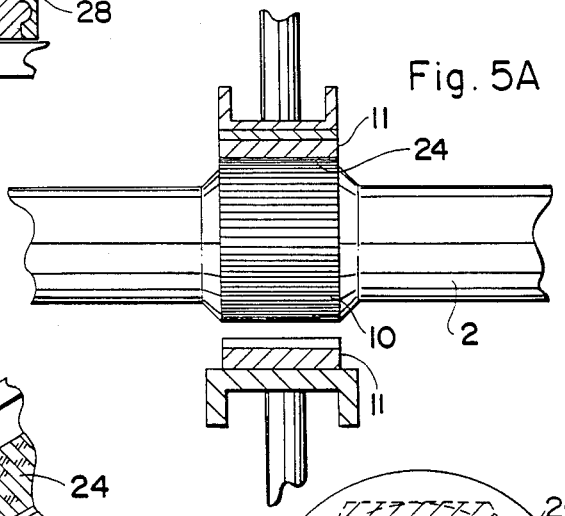
Fig. 5A
Fig. 4D
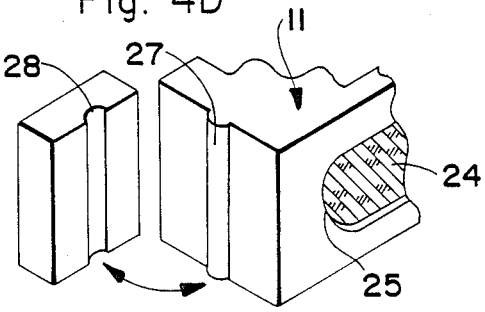
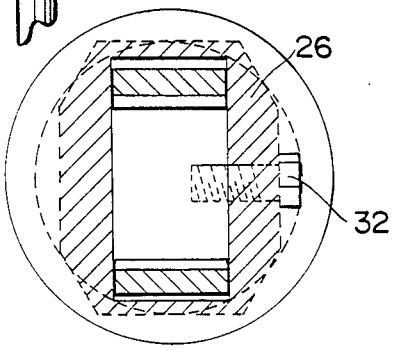
Fig. 5B

INTERNAL COMBUSTION ENGINE AND PISTON STRUCTURE THEREFORE

BACKGROUND OF THE INVENTION

Reciprocating piston internal combustion engines have been known for many years. An operating fundamental common to internal combustion engines of the reciprocating piston type is that the reciprocal motion of the pistons must be translated into rotary motion of a crankshaft. This has been achieved most conventionally through a connecting rod attached to each piston at one end through a wrist pin and rotatably mounted to an offset crank arm of the crankshaft at an opposite end.

Other arrangements for converting the reciprocal motion of the piston into rotary motion of a crankshaft have also been proposed. For example, it has been proposed to utilize an elongated internally toothed roller gear attached to a piston and moved to maintain engagement of the teeth with a crankshaft drive gear to impart rotation thereto. Examples of such arrangements are shown in U.S. Pat. Nos. 1,687,744, 4,608,951 and 4,395,977. Such arrangements have heretofore not achieved wide spread commercial acceptability.

Opposed cylinder internal combustion engines are also known. In such engines, dual pistons are fixed to a common yoke structure or connecting rod arrangement and the pistons are reciprocated within opposed cylinders. Reciprocal motion of the pistons is conventionally translated into rotary motion by an offset crank pin of a crankshaft. U.S. Pat. Nos. 2,172,670 and 2,122,676 disclose engine designs wherein opposed pistons are connected by a connecting rod arrangement. U.S. Pat. No. 4,485,768 discloses a common yoke type internal combustion engine as described and further includes means for altering the stroke and compression ratio of the engine. Specifically, this is achieved by altering the orbital path of a coaxial crank pin and slider relative to a crankshaft axis.

SUMMARY OF THE INVENTION

The present invention provides an improved design for a reciprocating type internal combustion engine. The invention has as its principal objects to provide a compact light weight reciprocating engine for use in a variety of applications wherein engine friction and vibration are reduced and fuel efficiency and power are substantially increased. The objects of the invention are achieved by the provision of a reciprocating internal combustion engine comprising an engine block and at least one pair of opposed and coaxially aligned cylinders in the engine block. A dual headed piston body is formed by a pair of first and second piston heads attached respectively to opposite ends of a central yoke structure. The first and second piston head bodies are adapted to reciprocate within each respective cylinder of the opposed cylinder pair. An internally toothed roller gear is mounted for rectilinear movement within the yoke structure. The roller gear is engageable with a crankshaft drive gear, and control and actuator means are provided for effective synchronized movement of the roller gear within the yoke structure to maintain constant engagement of the crankshaft drive gear with the roller gear as the dual-headed piston body reciprocates within the cylinder.

The invention further resides in the provision of a dual-headed piston body for use in an internal combustion engine adapted to receive roller gears of different size, thus allowing the piston stroke and effective cylindrical volume to be varied.

The present design provides efficient transfer of linear motion to rotary crankshaft motion. The design does not have unbalanced forces of conventional reciprocating engines. Thus, smooth operation is provided with minimal vibration. Engine size is reduced in the direction of the crankshaft axis since each dual piston body/cylinder uses a single main frame drive gear in contact with a respective roller gear. The design provides increased durability and efficiently. The piston body's low inertial forces reduce forces and stress on other engine parts and engine friction is decreased. Side thrust between pistons and cylinder walls is eliminated. Production costs are low as the relatively simple design means fewer parts, and machining operations are kept relatively simple. Finally, the feature of a removable roller gear provides significant engine size versatility in production.

BRIEF DESCRIPTION OF THE DRAWINGS

FIG. 4A is a side view of the dual-headed piston body of the present invention.

FIG. 4B is a top view of the dual headed piston body of the present invention.

FIG. 4C is a partial horizontal sectional view along section line D—D in FIG. 4A.

FIG. 4D is a pictorial broken-away view showing the mating surfaces of the roller gear and central yoke structure.

FIG. 5A is a partial cross-sectional close-up view of a crankshaft drive gear in engagement with an elongate roller gear and associated actuator mechanisms, of the present invention.

FIG. 5B is a vertical sectional view along section line E—E in FIG. 5A.

DETAILED DESCRIPTION OF THE PREFERRED EMBODIMENT

Figure 1:
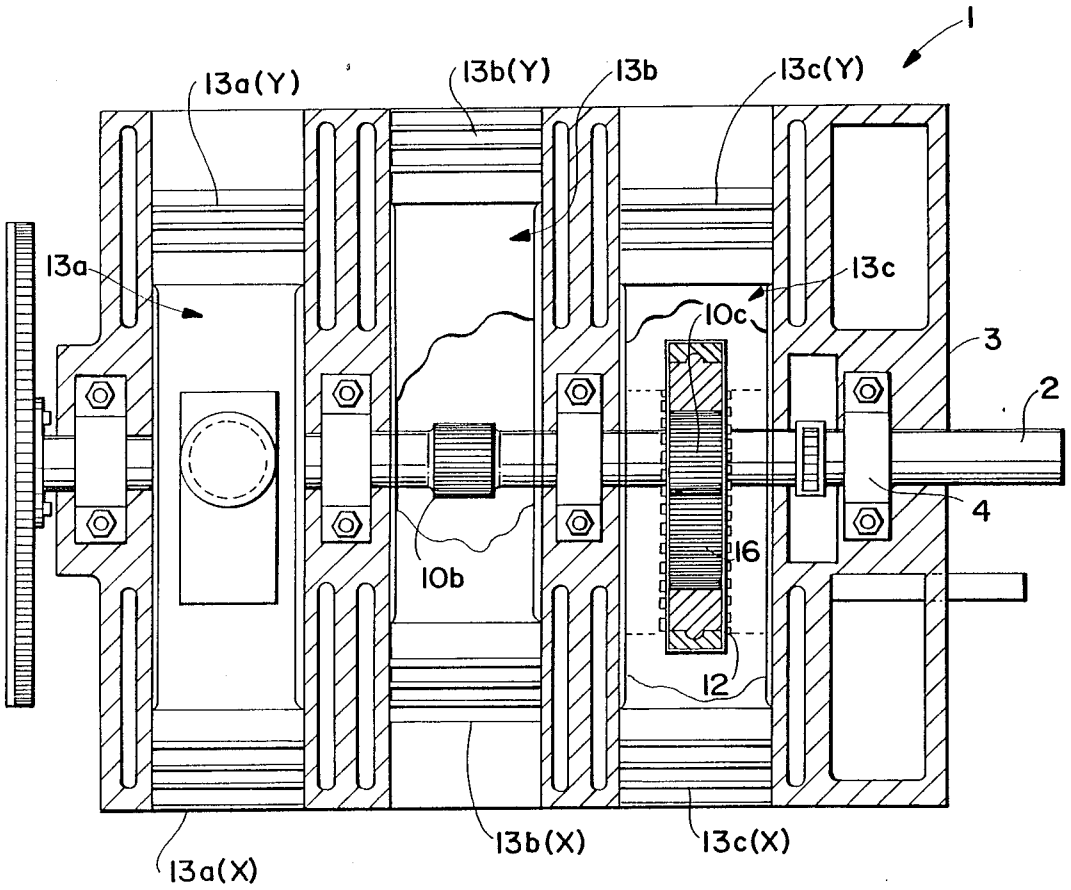
FIG. 1 is a horizontal sectional view of a preferred embodiment of the present invention taken along section line A—A in FIG. 2 and showing various cut-away views.

FIG. 1 illustrates generally a three opposed cylinder pair/dual headed piston body 1 of the present invention. Crankshaft 2 is mounted to engine block 3 by bearing mounts 4. Actuator camshaft 5 is rotatably secured by bearing mounts 6 to engine block 3. As seen best in FIG. 2, a timing chain 7 drives actuator camshaft 5 in a timed relation with the crankshaft 2. Timing chain 7 engages crankshaft sprocket 8 and actuator camshaft sprocket 9. In a preferred embodiment, sprockets 8 and 9 are sized to provide an actuator camshaft-crankshaft rotation ratio of 1:2.

Crankshaft drive gears 10*a*, 10*b* and 10*c* are fixedly mounted in a spaced relationship upon crankshaft 2 and are driven by the motion of roller gears 11*a*, 11*b* and 11*c* disposed within void 12 (see FIGS. 4A–4C) of dual-headed piston bodies 13*a*, 13*b* and 13*c*, as will be described in further detail below. Attached by known means to opposite ends of each dual headed piston body 13 are piston heads, designated for each dual headed piston body 13 with the subscripts X and Y.

Disposed along the actuator camshaft 5 are cam lobes 14*a*, 14*b* and 14*c*. The angular orientation of the cam lobes with respect to each other corresponds directly with the positional phase relationship of the three dual headed piston bodies 13, which in turn will depend on the desired firing order as described in further detail below.

Figure 3:
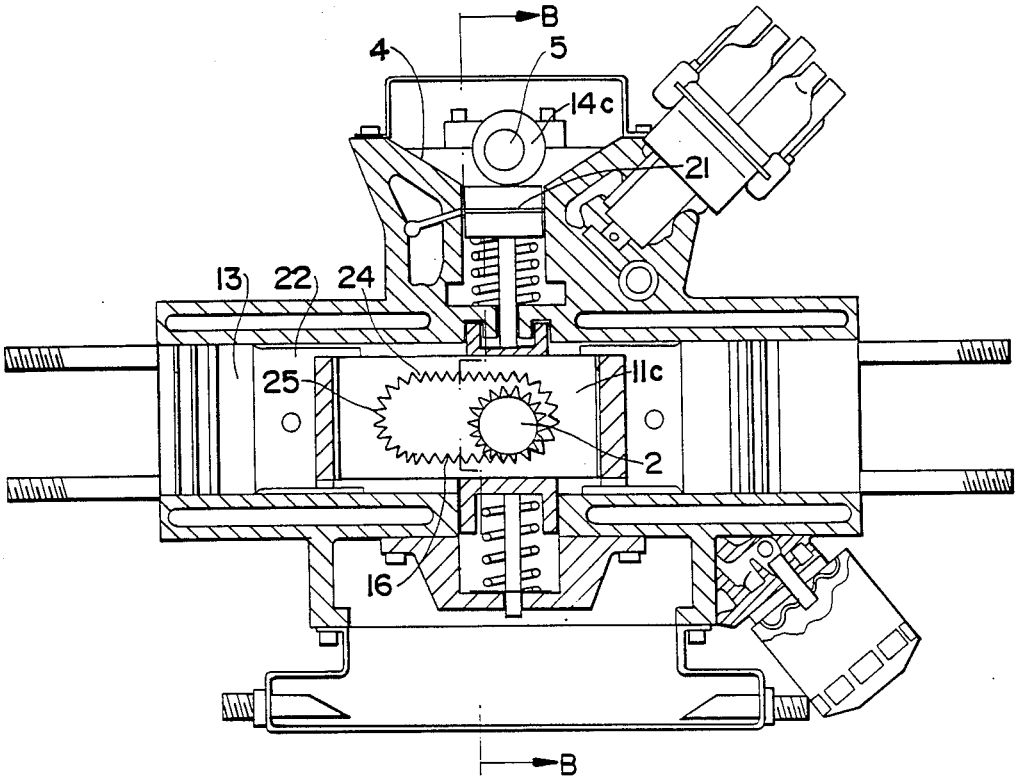
FIG. 3 is a transverse cross-sectional view along section line C—C in FIG. 2.

Upon rotation of actuator camshaft 5, the cam lobes actuate actuator mechanisms 15*a*, 15*b* and 15*c* which in turn move internally toothed roller gears vertically within dual headed piston body 13 to maintain constant engagement of the roller gear teeth 16 (FIGS. 1, 3 and 5A) with crankshaft drive gears 10 as the dual headed piston bodies 13 reciprocate back and forth. The combination movement of the roller gears 11 produces continuous rotational motion of the crankshaft 2.

Figure 2:
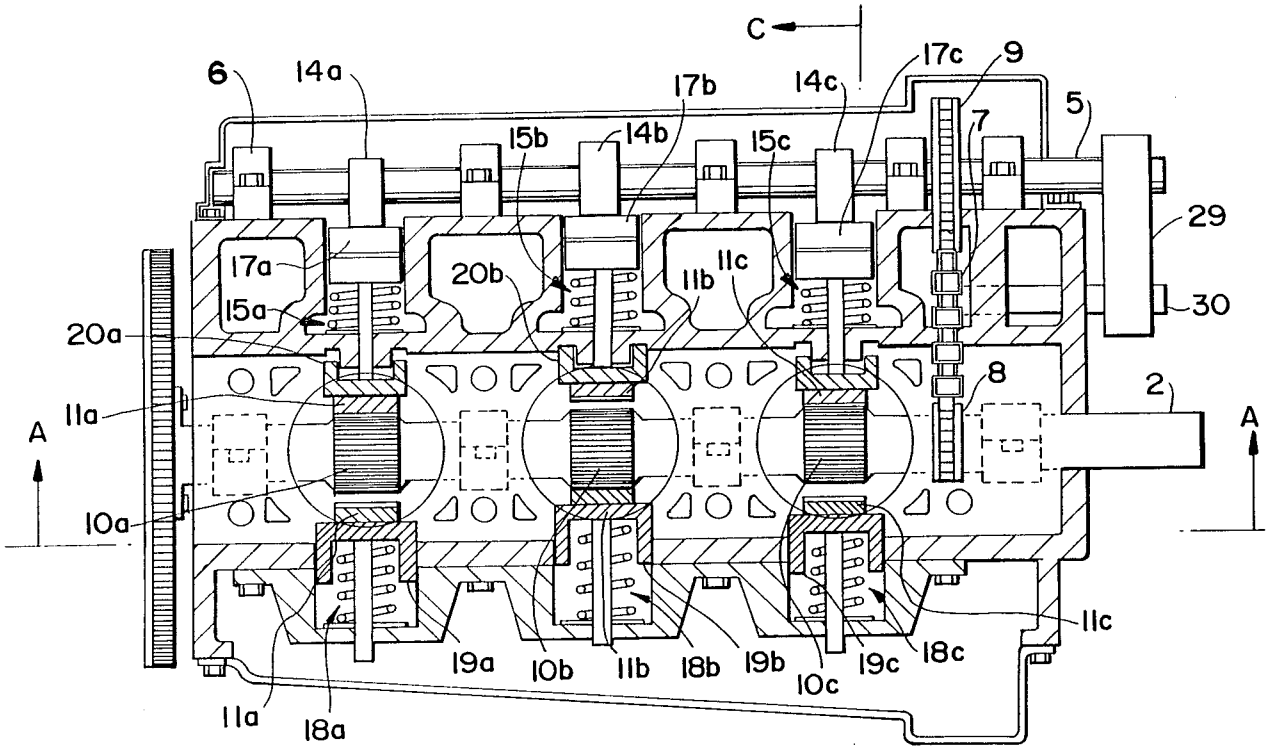
FIG. 2 is a vertical cross-sectional view along section line B—B in FIG. 3.

As shown in FIG. 2, actuator mechanisms 15 comprise respective actuator pistons 17*a*, 17*b* and 17*c* spring biased by respective springs towards the actuator camshaft 5 such that the upper end surfaces of each actuator piston 17 is maintained in engagement with each respective cam lobe 14.

The roller gears 11 are biased toward the actuator camshaft 5 by lower biasing mechanisms 18*a*, 18*b*, and 18*c* comprising spring biased inverted cups 19*a*, 19*b*, and 19*c*, against upright contact cups 20*a*, 20*b*, and 20*c* of actuator mechanism 15. In a preferred embodiment, the contact cups 19 and 20 of the lower biasing mechanisms 18 and the actuator mechanisms 15 are of circular shape. Lubrication is provided in a known manner to allow the roller gears 11 to reciprocate freely with the dual headed piston bodies 13 while contacting the cups 20 of the actuator mechanisms 15 and the cups 19 of the lower biasing mechanisms 18. As should be apparent, the vertical position of each respective roller gear 11 within each dual headed piston body 13 is directly related to the angular position of the respective cam lobes 14.

In a preferred embodiment, an hydraulic tappet mechanism 21 (see FIG. 3) is incorporated with each actuator piston 17 of each actuator mechanism 15. Each actuator piston 17 is divided into upper and lower portions and oil supplied from a known hydraulic pressure source forms a hydraulic fluid layer therebetween. The hydraulic fluid layer acts as a fluid buffer to provide smooth and quiet shifting of the elongated roller gear 11 from its top to its bottom engagement positions.

Typical valve train springs may be used for the spring biasing mechanisms of actuator mechanisms 15 and lower biasing mechanisms 18. In a preferred embodiment, the actuator piston biasing spring has a preferable stiffness of 86 pounds and the lower biasing mechanism spring of 115 pounds.

As seen in FIGS. 4A, 4B and 5B, the central yoke portion 22 of each dual headed piston body 13 is provided with a void 12 used to slidably retain roller gear 11.

Roller gears of various sizes may be accommodated within void 12. In a preferred embodiment the roller gear 11 is elongated with gear teeth 16 comprising upper and lower linear gear teeth racks 24 connected through arcuate end portions 25. By exchanging one size roller gear with another of shorter or longer length, the stroke and displacement of the dual-headed piston body 13 can be varied. It is then necessary to change the size of actuator camshaft sprocket 9 and crankshaft sprocket 8 to alter the camshaft to crankshaft rotational ratio. Most other engine parts can remain the same.

Upon placement of the roller gear 11 within the void 12, it is secured against movement in the lengthwise direction of the crankshaft 2 by retaining plate 26 mounted to the side of central yoke structure 22 of the dual-headed piston body 13, by bolts 32. An arcuate cut-out portion 23 is provided in retaining plate 26 to allow the crankshaft main gears 10 to pass through the central yoke structure 22 and roller gears 11 during assembly, and to accomodate the combination motion of the roller gears 11 relative to the main gears 10 during engine operation. A tight lengthwise fit of the roller gear 11 within void 12 is provided to avoid movement of the roller gear 11 within the void 12 in the longitudinal directions of the dual headed piston body 13.

As shown in FIGS. 4C and 4D, roller gear 11 moves up and down within the central yoke structure 22 by means of a rail and slot arrangement. The roller gear 11 may include a rail 27 and the central yoke structure 22 may include a slot 28 (as shown) or vice versa. Oil is supplied to the main gears of the crankshaft from the crankcase in a known manner and such oil also lubricates the rail and slot arrangement enabling free vertical movement of the roller gear within the void 12.

FIG. 5A provides a close-up view of roller gear 11 in engagement with a crankshaft drive gear 10. As shown, the top linear rack of gear teeth 24 of roller gear 11 is in engagement with crankshaft drive gear 10 of the crankshaft 2.

The engine of the present invention may be provided as a two stroke or four stroke type, utilizing port valves or overhead valves as are known generally in the art. In the case of overhead valves, two valve camshafts (one associated with each side of the opposed cylinder pairs) are driven by timing belts engaged with the crankshaft 2 (not shown). A V-belt engaged with the crankshaft 2 may be used to drive an alternator and water pump (not shown). As seen in FIG. 2, belt or chain 29 mounted on actuator camshaft 5 is used to drive jackshaft 30 which may in turn drive an oil pump and a vertical distributor.

The present invention contemplates various firing orders and positional phase relationships of the three dual headed piston bodies 13. In a first preferred embodiment, the engine is provided as a two-stroke type and the dual headed piston bodies 13 move in phase with respect to each other. In operation, simultaneous firing of all three cylinders on one side of the crankshaft 2 occurs driving each dual headed piston body 13 through a single stroke, whereby, each just fired piston reaches bottom dead center (bdc), and each opposite piston reaches top dead center (tdc). At this point, simultaneous firing of the opposite cylinders occurs. Preferably, the crankshaft rotates 360° for a single stroke of roller gear 11 (2:1 crankshaft/roller gear ratio). In such case, the tdc position is maintained for approximately 12° of the crankshaft rotation as the crankshaft drive gears pass through the arcuate end portions 25 (FIG. 3) of the elongated roller gear 11. This pause at tdc allows maximum combustion and pressure development following ignition. Firing at the opposite cylinders drives the dual headed piston bodies 13 back and a single cycle of the engine is completed. Since the motion of the dual headed piston bodies 13 in the phase, the angular orientation of the actuator cam lobes 14 is identical.

In a second two stroke embodiment, dual headed piston bodies 13*a* and 13*c* are positioned and move in phase. Dual headed piston body 13*b* is positioned out of phase by 180°. This arrangement is shown in drawing FIGS. 1 and 2. As in the first embodiment, simultaneous firing of three cylinders occurs. However, since the power stroke of one dual headed piston body (13*b*) is opposed in direction to those of the other two (13*a* and 13*b*), vibration is minimized. In this embodiment, the angular orientation of cam lobes 14*a* and 14*c* is identical. Cam lobe 14*b* is rotated 180° with respect to cam lobes 14*a* and 14*c*.

In a four stroke embodiment, a progressive firing order can be utilized. Namely, no simultaneous firing occurs. Rather, the dual headed piston bodies 13 are positioned and move 120° out of phase with respect to each other. The sequential stages of power, exhaust, intake and compressor occur individually at 60° intervals of the 720° engine cycle (two 360° cycles of the dual headed piston body and two full rotations of the actuator camshaft 5). In this embodiment, the cam lobes 14*a*–14*c* are angularly spaced by 120°.

The opposed piston design requires that opposite pistons of each dual headed piston body 13 undergo each engine stage in a 180° phase relationship with respect to each other, since when one piston is at tdc, the other is at bdc. The following chart illustrates an exemplary four stroke sequential engine operation cycle, where P=power, E=exhaust, I=intake, and C=compression. X and Y denote opposed pistons of each dual headed piston body 13.

| | Actuator Camshaft Angle | | | | | |
|---|---|---|---|---|---|---|
| Piston | 0°/360° | 60°/420° | 120°/480° | 180°/540° | 240°/600° | 300°/660° |
| 13a (X) | P/I | | | E/C | | |
| 13b (Y) | | | P/I | | | E/C |
| 13c (X) | | E/C | | | P/I | |
| 13a (Y) | E/C | | | P/I | | |
| 13b (X) | | | E/C | | | P/I |
| 13c (Y) | | P/I | | | E/C | |

An alternative four stroke firing order is shown in the table below. In this embodiment, the dual headed piston bodies 13 and actuator camshaft lobes 14 are positioned and move in the manner described above with respect to the second two-stroke embodiment (the position and movement of dual headed piston body 13*b* is 180° out of phase with dual headed piston bodies 13*a* and 13*c*).

| | Actuator Camshaft Angle | |
|---|---|---|
| Piston | 0/360° | 180/540° |
| 13a (X) | P/I | E/C |
| 13a (Y) | C/E | P/I |
| 13b (X) | P/I | E/C |
| 13b (Y) | C/E | P/I |
| 13c (X) | I/P | C/E |
| 13c (Y) | E/C | I/P |

The sequential engine steps of piston heads 13a (X), (Y) occur in unison (simultaneous) with the sequential engine steps of piston heads 13*b* (X), (Y), respectively. The sequential engine steps of piston heads 13*c* (X), (Y) occur 360° out of phase with respect thereto.

Other possible firing orders will occur to those skilled in the art upon a review of this disclosure.

In producing the preferred embodiments disclosed herein, the engine block 3 may be cast of one piece heat-treated 390 aluminum alloy using known technology. The actuator camshaft 5 may be of nodular cast iron and is introduced into the top of the engine block 3 in the same manner as are conventional "V-type" overhead camshaft assemblies.

The dual headed piston bodies 13 are inserted into the cylinders until the position of the respective arcuate cut-out portions 23 of retaining plates 26 coincide with the crankshaft entry passage in each opposed cylinder pair. A roller gear 11 is placed within the void 12 of each central yoke structure 22 and the retaining plates 26 are secured thereon prior to introducing dual headed the piston bodies 13 into the opposed cylinders pairs. The crankshaft is inserted through the central yoke structures 22 and secured to the engine block 3 by main bearings 4.

Having thus described the present invention in terms of specific preferred embodiments thereof, it is to be understood that other embodiments will become apparent to those skilled in the art. Thus, the scope of the present invention is limited only by the appended claims.

What is claimed is:

1. A reciprocating internal combustion engine comprising:

an engine block;

at least one pair of coaxially aligned cylinders in said engine block;

a dual-headed piston body comprising first and second piston heads attached to opposite ends of a central yoke structure, said first and second piston heads being adapted to reciprocate within respective cylinders of said pair of cylinders;

a roller gear mounted within said yoke structure for rectilinear movement with respect to said yoke structure, said roller gear being engageable with a crankshaft drive gear;

control means and actuator means for effecting synchronized movement of said roller gear within said yoke structure to maintain constant engagement of the roller gear with the crankshaft drive gear as the dual headed piston body reciprocates within respective cylinders of said pair of cylinders.

2. A reciprocating internal combustion engine as described in claim 1, wherein said roller gear is an elongated internally toothed roller gear.

3. A reciprocating internal combustion engine as described in claim 1, said control means comprising a camshaft rotated in timed relation to said crankshaft and a cam lobe of said camshaft being arranged to actuate said actuator means, said actuator means including an actuating mechanism contacting said roller gear at a first surface thereof.

4. A reciprocating internal combustion engine as described in claim 3, wherein said actuating mechanism is biased toward the cam of said camshaft and a biasing mechanism of said actuator means is biased against the roller gear at a second surface opposite said first surface.

5. A reciprocating internal combustion engine as described in claim 4, wherein said actuating mechanism includes a hydraulic layer buffering the movement of the roller gear within said yoke structure.

6. A reciprocating internal combustion engine as described in claim 1, wherein said engine has three cylinders and a corresponding number of dual-headed piston bodies, cam lobes and actuating means.

7. A reciprocating internal combustion engine as described in claim 3, wherein said rotation in timed relation is achieved by a timing chain engaging sprockets mounted respectively on said crankshaft and said camshaft.

8. A reciprocating internal combustion engine as described in claim 1, wherein the rectilinear movement of said roller gear is facilitated by a cooperating rail and slot arrangement of said roller gear and central yoke structure.

9. A reciprocating internal combustion engine as described in claim 1, wherein said central yoke structure is arranged to removably accommodate therein roller gears of different sizes.

10. A reciprocating internal combustion engine as described in claim 9, wherein said central yoke structure comprises a void for receiving therein said roller gears of different sizes and a removable retaining plate member for slideably securing one of said roller gears within said void.

11. A reciprocating internal combustion engine as described in claim 9, wherein the rectilinear movement of said roller gear is facilitated by a cooperating rail and slot arrangement of said roller gear and central yoke structure.

12. A dual-headed piston body as described in claim 4, wherein the rectilinear movement of said roller gear is facilitated by a cooperating rail and slot arrangement of said roller gear and central yoke structure.

13. A reciprocating internal combustion engine as described in claim 6, wherein the position and movement of the dual headed piston bodies is in phase with each other.

14. A reciprocating internal combustion engine as described in claim 6, wherein the position and movement of two of said dual headed poisition bodies is in phase with each other, and the position and movement of a third of said dual headed piston bodies is 180° out of phase with respect to said other two.

15. A reciprocating internal combustion engine as described in claim 6, wherein the position and movement of the dual headed piston bodies have a phase relationship of 120° with respect to each other.

16. A dual-headed piston body for use in a reciprocating internal combustion engine, comprising two piston heads attached to opposite ends of a central yoke structure, said yoke structure being adapted to removably receive therein internally toothed roller gears of different size to vary the effective stroke and cylindrical volume of the internal combustion engine

.

17. A dual-headed piston body as described in claim 16, wherein said central yoke structure comprises removable plate means for securing one said roller gears slideably in place such that said roller gear may be moved reciprocally in directions transverse to the longitudinal axis of said dual-headed piston body.

18. A dual-headed piston body as described in claim 17, wherein the reciprocal movement of said roller gear is facilitated by a cooperating rail and slot arrangement of said roller gear and central yoke structure.

* * * * *